US006540622B2

(12) United States Patent
Buchanan

(10) Patent No.: US 6,540,622 B2
(45) Date of Patent: Apr. 1, 2003

(54) GOLF PUTTER CLUB

(76) Inventor: Douglas Boyd Buchanan, 17 Burway Trading Estate, Bromfield Road, Ludlow, Shropshire (GB), SY8 1EN ( * ) Notice: Subject to any disclaimer, the term of this patent is extended or adjusted under 35 U.S.C. 154(b) by 0 days.

(21) Appl. No.: 09/876,140

(22) Filed: Jun. 8, 2001

(65) Prior Publication Data

US 2001/0027138 A1 Oct. 4, 2001

Related U.S. Application Data

(63) Continuation of application No. 09/151,449, filed on Sep. 11, 1998, now Pat. No. 6,251,027.

(30) Foreign Application Priority Data

Sep. 24, 1997 (GB) ..... 9720192
Nov. 25, 1997 (GB) ..... 9724734

(51) Int. Cl.[7] ..... A63B 53/14; A63B 53/02
(52) U.S. Cl. ..... 473/300; 473/305; 473/313; 473/316
(58) Field of Search ..... 473/313, 251, 473/314, 340, 305, 316, 317, 289, 292, 309, 315, 320, 321, 300, 201, 202, 203, 204, 205, 206, 568, 302–303; D21/756

(56) References Cited

U.S. PATENT DOCUMENTS 1,630,249 A * 5/1927 Babbitt
2,092,839 A * 9/1937 Gouverneur
2,131,966 A * 10/1938 Nelson
2,437,404 A * 3/1948 Robinson
2,459,996 A * 1/1949 Duncan
2,820,638 A * 1/1958 Morrison
3,231,281 A * 1/1966 Wallo
3,837,647 A * 9/1974 Jacques
3,860,244 A * 1/1975 Cosby
4,815,739 A * 3/1989 Donica
5,137,275 A * 8/1992 Nelson
5,322,285 A * 6/1994 Turner
5,545,094 A * 8/1996 Hsu
5,547,189 A * 8/1996 Billings
5,569,098 A * 10/1996 Klein
5,573,468 A * 11/1996 Baumann
5,653,644 A * 8/1997 Jaeckel
5,653,645 A * 8/1997 Baumann
6,050,903 A * 4/2000 Lake
6,095,929 A * 8/2000 Clark
6,251,027 B1 * 6/2001 Buchanan

* cited by examiner

*Primary Examiner*—Sebastiano Passaniti
(74) *Attorney, Agent, or Firm*—Liniak, Berenato & White, LLC

(57) ABSTRACT

A golf putter is provided. The putter is made of a substantially large (between 25 and 45 mm diameter) parallel thin walled shaft wherein part of the bare shaft forms the grip. A protruding curved end cap forms part of the grip to assist in consistency of positioning the hands when taking a grip of the putter. A thin walled end plate closes off the shaft to the putter head all being designed to maximize "feel" when strokiing the ball.

13 Claims, 2 Drawing Sheets

FIG. 1

GOLF PUTTER CLUB

This application is a continuation of application Ser. No. 09/151,449, filed Sep. 11, 1998, now U.S. Pat. No. 6,251,027.

BACKGROUND AND SUMMARY OF THE INVENTION

This invention relates to a golf putter club. The game of golf has been played for at least five hundred years. Early clubs were made entirely of wood. Gradually the materials used in clubs changed. Metal was used for heads, stainless steel, titanium and composites used for shafts. Leather spiral bound grips gave way to molded rubber and man made materials. The overall shape, however, did not change i.e. a hitting head and a small diameter tapering shaft.

All clubs except the putter hit the ball extremely hard, so a certain amount of shaft flex is desirable, except in the case of the putter. In putting, which is of a gentle nature, feel is crucial.

In my United Kingdom patent application specification No. 9720192.5 I disclosed a golf putter designed to maximize feel during the putting stroke. The present invention is a further definition of the invention disclosed in my UK patent specification No. 9720192.5. Both UK patent applications are incorporated herein in their entireties by reference.

According to the present invention there is provided a golf putter comprising a shaft having a grip end and a head end, a putter head having a striking face, connected to the head end wherein the shaft is a substantially large cross-sectional dimension parallel shaft.

To this end, the invention uses a thin walled, high tensile tube of a large diameter and a T shaped club head of rectangular section material. The invention comprises of a large diameter, thin walled tube connected to the T shaped club head by means of a short transition piece. Although the invention preferably comprises a circular shaft of large cross-sectional dimension, that is, diameter, the Rules of Golf permit non-circular cross-sections for putter grips, hence oval and U-shaped cross sections are within the scope of the present invention. In the case of an oval shaft the substantially large cross-sectional dimension would be the major diameter and in the case of a U-shaped section it would be the dimension between the flat surface and the radiused end.

Other objects, advantages and novel features of the present invention will become apparent from the following detailed description of the invention when considered in conjunction with the accompanying drawings.

DESCRIPTION OF THE PREFERRED EMBODIMENTS

Figure 1:
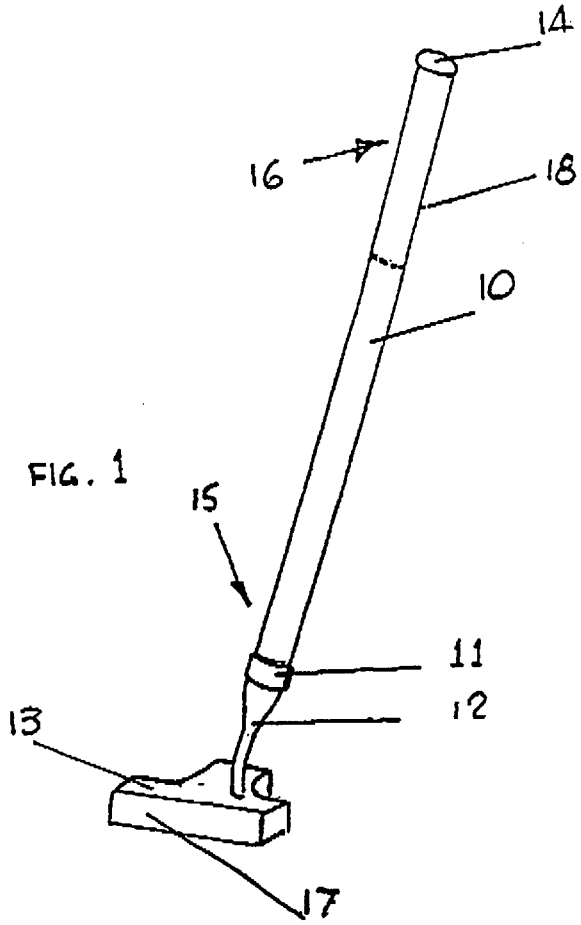
FIG. 1 is a perspective view of the putter with hollow shaft and T shaped head.
Figure 4:
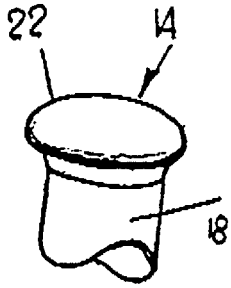
FIG. 4 is a partially fragmented elevational view of a protruding end cap in accordance with the invention.
Figure 5:
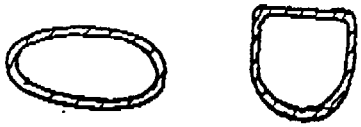
FIG. 5 shows oval and U-shaped cross sections.
Figure 2:
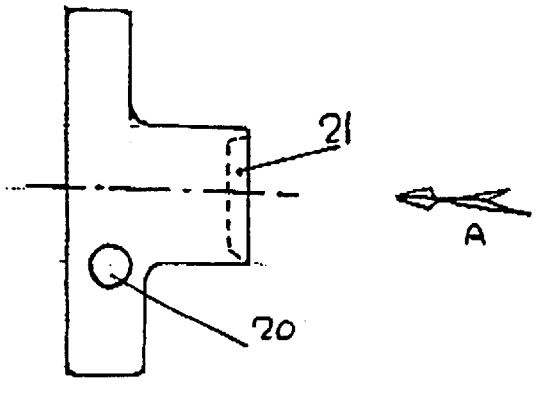
FIG. 2 is a plan view of the club head.
Figure 3:
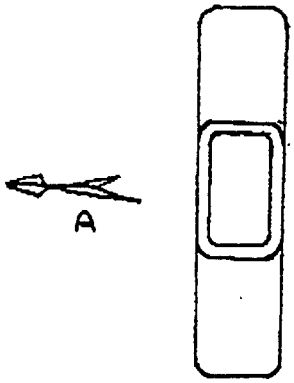
FIG. 3 is a rear elevational view of the club head of FIG. 2 as seen in the direction of arrow A which shows a rectangular head section.

Referring to the drawings, the shaft 10 is a thin walled tube of sufficiently large diameter to maximize hand feel and is made from a variety of high tensile materials such as aircraft quality aluminum stainless steel, composite material, titanium, high performance alloy such as magnesium or lithium enhanced alloy or similar suitable material to maximize feel of the contact with the ball to be transmitted through the shaft to the hands of the player.

The shaft 10 ends in a transition piece 12 which connects the shaft to the club head and is hollow to allow the transmission of contact. The hollow transition piece 12 is made of a suitable material composite, aluminum titanium, alloy or high density plastic. The transition piece is a tight push fit into the putter head 13 and into the shaft via collar 11 which is also a tight push fit. Both are positively positioned with either pin or screw. The putter head 13 is made from a lightweight alloy suitably weighted to provide a balanced feel. The top of the shaft is finished off with a slightly proud hollow end cap 14. Shaft 10 as seen in FIG. 1 is parallel throughout its entire length and is not tapered nor stepped and comprises a head end 15 and a grip end 16 whilst putter head 13 includes a striking face 17.

Normally a portion of the grip end 16 would be fitted with a rubber leather grip. This putter grip would tend to absorb some of the vibrations coming up the shaft at impact and it is thought this is detrimental to maximize feel. Accordingly in this invention a portion 18 of shaft 10 delineated by the dotted lines, FIG. 1, forms the grip. In other words a conventional grip, per se, is dispensed with or omitted and the bare shaft is used as the grip. Accordingly in one sense it could be said a non-slip, non-shock absorbing grip is provided. It has been found that a circular carbon fibre shaft of substantially large cross-sectional dimension, that is, a diameter of between 25 and 45 mm, preferably 31 mm with a thin wall thickness of between 0.75 and 1 mm is best used in the practice of the invention.

Protruding end cap 14 exceeds the diameter of shaft 10 by about 1.00 to 3.00 mm per side and has a curvilinear surface 22. The curved surface 22 is designed to fit snugly into the heel of the hand at the base of the thumb of the user's hand. This is useful in that it assists in maintaining consistency of positioning of the hands when taking grip of the putter. Also the use of a substantially larger than normal diameter shaft will assist in stabilizing the hands and fingers when gripping the putter.

Figure 6:
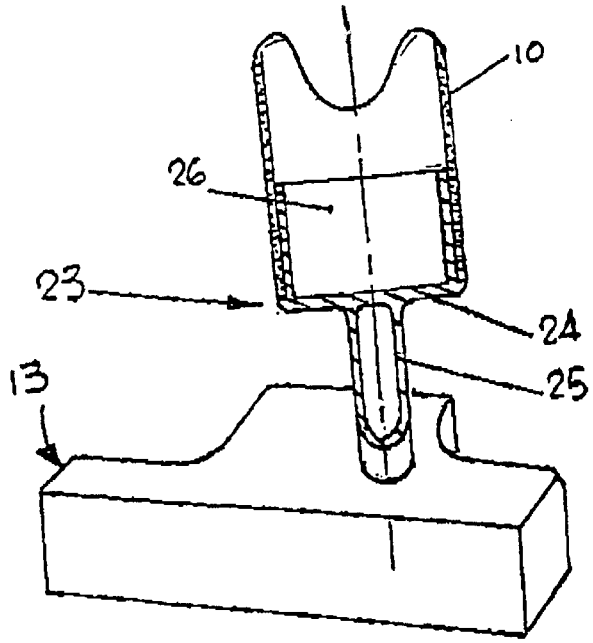
FIG. 6 is a part sectional view of a further embodiment of the present invention.

In FIG. 6 there is illustrated a connection 23 between the putter head 13 and shaft 10 which is an important part of the present invention. Connection 23 includes a thin walled end plate 24 of between 0.75 mm and 1.5 mm thickness which bridges across and in this case closes off the end of shaft 10.

Figure 7:
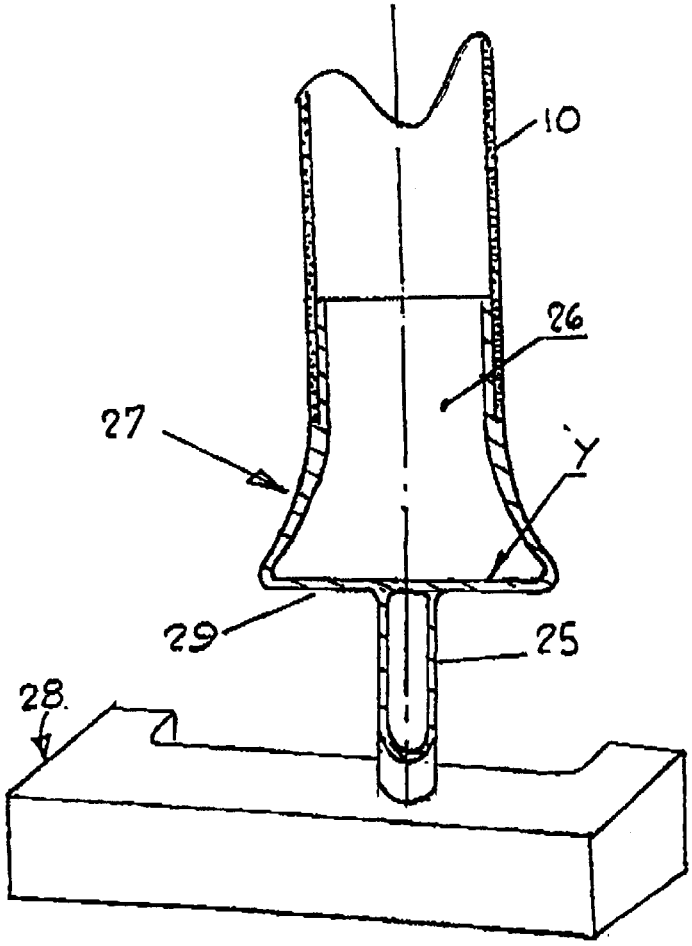
FIG. 7 is a part sectional view of an alternative embodiment to the embodiment shown in FIG. 6.

Dependiing from end plate 24 is a thin walled hollow hosel member 25 which attaches to putter head 13 and arising from plate 24 is an upper projecting portion 26 which attaches to the inside of shaft 10. Connection 23 may be in the form of a lightweight metal alloy casting or any of the materials mentioned with respect to transition piece 12. The thin walled end plate 24, can, to some extent provide a "drumskin" effect, that is, form a diaphragm which will tend to enhance transmission of feel from putter head 13 to shaft 10. FIG. 7 illustrates how connection 27 between shaft 10 and head 28 may be constructed to provide a thin walled end plate 29, enlarged to be greater then the diameter of shaft 10 to increase the "drumskin" effect. In this example, connection 27 is flared thus giving a bell-mouthed effect which increases the area of end plate 29 over the area corresponding to the area provided by the grip end shaft diameter shown in FIG. 6. In the example of FIG. 7, connection 27 forms a continuation of shaft 10.

In order to locate the transition piece there is a deep blind hole location 20, the position of which can be located to suit the techniques of the individual player. To meet the requirements of the Rules of Golf as laid down by the royal and Ancient Golf Club of St. Andrews and the United States Golf Association, there is a recess 21 of sufficient depth rendering the rear face of the head unsuitable for play since to be legal under the above Rules a golf club may have one striking face only.

What is claimed is:

1. A golf putter, comprising a putter head having a striking face;

a hollow, non-tapered shaft having a grip end, a head end, an axis extending between said ends, and a cross-sectional dimension orthogonal to said axis, said dimension being at least about 25 mm in length; and a connection member extending between said shaft and said putter head, said connection member including a hollow upper portion operatively connected to said shaft, a hollow hosel member operatively connected to said putter head, and a plate connecting said upper portion and said hosel member.

2. The golf putter according to claim 1, wherein:

said connection member is made of a material selected from the group comprising a composite material, aluminum, an aluminum alloy, titanium, a titanium alloy, and plastic.

3. The golf putter according to claim 2 wherein:

said plastic is high density plastic.

4. The golf putter according to claim 1, wherein:

said upper portion has a first end adjacent said shaft and a second end adjacent said plate, said hosel member has a first end adjacent said putter head and a second end adjacent said plate, said plate covering said second ends.

5. The golf putter according to claim 4, wherein:

said plate has a thickness of no more than about 1.5 mm.

6. The golf putter according to claim 5, wherein:

each of said upper portion and said hosel member has a circular cross-section.

7. The golf putter according to claim 6, wherein:

said upper portion and said hosel member are non-tapered.

8. The golf putter according to claim 6, wherein:

said head end has an outer diameter greater than an inner diameter of said upper portion, and said head end is forced-fit onto said upper portion.

9. The golf putter according to claim 8, wherein:

said upper portion has a diameter greater than a cross-sectional dimension of said hosel member.

10. The golf putter according to claim 6, wherein: said upper portion has a diameter greater than a diameter of said hosel member.

11. The golf putter according to claim 10, wherein:

said plate thickness is no less than about 0.75 mm.

12. A golf putter, comprising a putter head having a striking face;

a hollow, non-tapered shaft having a grip end, a head end, an axis extending between said ends, and a cross-sectional dimension orthogonal to said axis, said dimension being at least about 25 mm in length; and a connection member extending between said shaft and said putter head, said connection member including a hollow upper portion operatively connected to said shaft, a hollow hosel member operatively connected to said putter head, and a plate connecting said upper portion and said hosel member, wherein said upper portion is flared.

13. The golf putter according to claim 12, wherein:

said upper portion includes a first end adjacent said shaft and a second end adjacent said plate, said upper portion having a cross-sectional dimension that is smaller at said first end than at said second end.

* * * * *